United States Patent [19]

Kelly et al.

[11] Patent Number: 4,593,747

[45] Date of Patent: Jun. 10, 1986

[54] INGOT MOULD REPAIR METHOD

[75] Inventors: Edward Kelly, Guelph; Frederick T. Bishop, Burlington; Donald J. Reilly, Guelph, all of Canada

[73] Assignee: Recastco Inc., Burlington, Canada

[21] Appl. No.: 556,374

[22] Filed: Nov. 30, 1983

[51] Int. Cl.[4] ..... B22D 27/02

[52] U.S. Cl. ..... 164/496; 164/92.1

[58] Field of Search ..... 164/496, 497, 92.1, 164/98, 99; 219/508, 509, 73.1, 76.1

[56] References Cited

U.S. PATENT DOCUMENTS

| | | | |
|---|---|---|---|
| 2,191,482 | 2/1940 | Hopkins | 164/496 |
| 3,891,821 | 6/1975 | Evertz | 164/92.1 |
| 3,920,948 | 11/1975 | Schokkenbroek | 164/92.1 |
| 4,054,775 | 10/1977 | Campana | 219/137 WM |

FOREIGN PATENT DOCUMENTS

| | | | |
|---|---|---|---|
| 702715 | 1/1965 | Canada | 219/76.1 |
| 2319442 | 2/1977 | France | 164/92.1 |
| 4731226 | of 1972 | Japan | 219/73.1 |

*Primary Examiner*—Nicholas P. Godici
*Assistant Examiner*—G. M. Beid
*Attorney, Agent, or Firm*—Fetherstonhaugh & Co.

[57] ABSTRACT

The invention is a method for rebuilding grey cast iron ingot moulds that have a cavity erroded therein and the concept is to fill the cavity with cast iron from a tubular wire supply by electric arc deposit at a rate such that the heat supplied by the electric arc deposit is sufficient to prevent chilling of the cast iron that is deposited whereby on cooling the cavity is filled with substantially graphitic cast iron.

2 Claims, 3 Drawing Figures

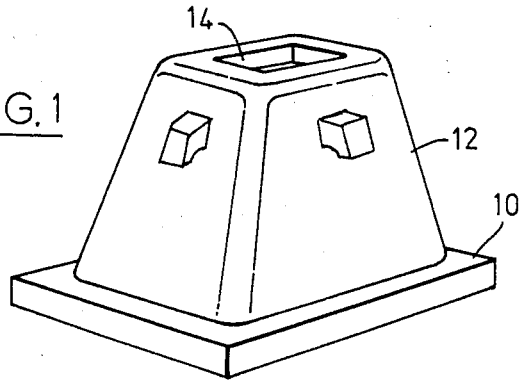
F.I G. 1
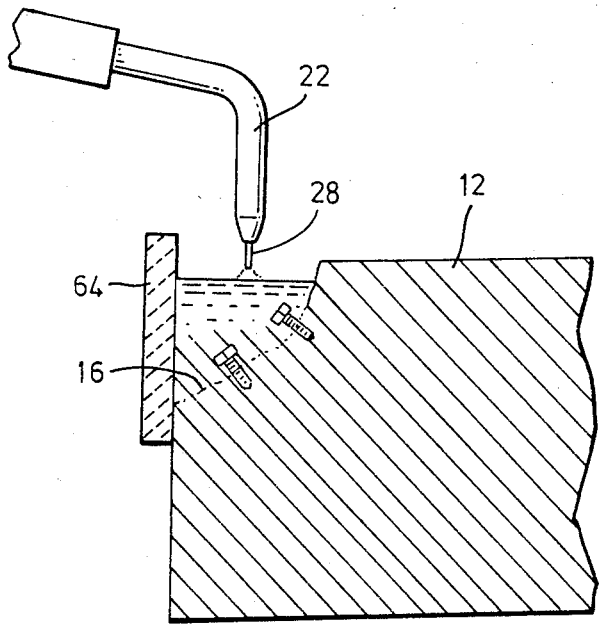
F I G. 3

INGOT MOULD REPAIR METHOD

This invention relates to a method of rebuilding and/or repairing grey cast iron ingot moulds which, through use, have developed cavities, and to a machine for feeding multiple tubular wires depositing a graphitic cast iron into a cavity by means of electric arc welding technique.

Tubular welding wire, as referred to herein, is a continuous tubular sheath containing a filler composition, which in combination yield a weld deposit of graphitic cast iron structure when applied by electric arc welding technique.

The technique of providing a tubular welding wire with a sheath and core composition is well known in the art. These cores are usually powdered and the tubular wires are flexible for feed purposes from a reel or the like.

The term "cast iron" as hereinafter used, comprises an alloy of iron, carbon, and silicon as major elements and may have additional minor elements. It will have a carbon equivalent value of between about 1.7 and 4.8. Carbon equivalent in the case where Si and P are used is total carbon plus $\frac{1}{3}$ the sum of silicon and phosphorous, (ie. if C=3, Si=1.8, P=0.3, then the carbon equivalent=3.7). Carbon equivalent is most commonly 3.5 to 4.5 for so-called grey cast iron, ingot mould cast iron composition being typically 4.1 to 4.5 carbon equivalent. Grey cast iron contains most of its carbon in the uncombined or free state as graphite and is easily machined. In chilled cast iron, most of the carbon is combined chemically in massive forms of free cementite and within an interdendritic structure of pearlite, and the metal is very hard. Grey cast iron has a Brinnel hardness of under 100 to 280, depending on the composition and cooling rate. Chilled cast iron has a hardness above 320 on the Brinnel scale. These parameters for cast iron are known in the art.

In the manufacture of steel, molten steel from furnaces is poured into ingot moulds. These moulds are made from grey cast iron which is chosen because of its good heat transfer properties. This aspect of grey cast iron is largely due to the presence of contained carbon as free graphite. This free graphite has a low specific gravity relative to iron and may occupy up to 17% of the total iron volume. In use, the steel-pouring process erodes cavities in the moulds and stools at critical locations. These cavities produce ingots with appendages on the sides and/or ends which result in increased costs when further processing the ingot. The cavities reach a size where either the cavity must be repaired or the mould or stool must be scrapped for reasons of economy and prevention of molten metal run-outs. The cost of replacing moulds or stools is a significant cost in steel manufacturing and mould and stool repair is an endeavour to which considerable attention is being directed.

Some present practise is to scarf and/or grind the defective area of the mould to improve useful life and ingot quality.

Another current practise is to repair cavities using a bare cast iron filler rod and mild steel electrode by electric arc welding. The mild steel electrode is used as the heat source as well as depositing mild steel metal, while the bare cast iron rod is hand fed into the arc and molten pool, resulting in a chilled semi-steel structure.

This process is slow, involves a non-continuous deposit, slag producing and costly.

Another practice is to use a bare cast iron electrode in electric welding, which produces a substantially chilled iron structure. Complete fusion of weld is difficult to achieve using this method, it is a non-continuous deposit, costly, slow and produces a very hard and brittle weld structure.

A thermite method of filling the cavity has been used with some success. This involves the deposit of a powdered iron oxide and aluminum mixture into the cavity, igniting it to cause a sudden chemical reaction that releases excessive heat and leaves a filling deposit that is fused into the cavity. A disadvantage of the thermite process is that it emits an objectionable amount of smoke and obnoxious fumes. The resultant weld structure is usually of the semi-steel type.

An ideal cavity repair material should be similar in chemistry and structure to the base metal of the mould or stool. Coefficient of expansion characteristics and thermal conductivity of the weld metal should be similar to the cast iron of the mould or stool. It is important that the material used to fill the cavity should be readily grindable because after the cavity is filled, the repair area must be ground to make it conform to the required surface of the mould or stool. It is also desirable that the filling material should have heat-flow, expansion and contraction characteristics similar to the grey cast iron of the mould or stool. Current practises fall short of ideal compatibility, because the heat transfer of ingot mould iron and the massive heat sink from the mass of the mould causes weld metal of suitable analysis deposited in the cavity to cool so rapidly that a chilled metal structure results, wherein most carbon is chemically combined.

It would be preferable to fill the cavity with substantially graphitic cast iron but, prior to this invention, no commercial method for filling the cavities in these moulds using arc deposit has been discovered. The requirement is to fill the cavity with cast iron under conditions so that the cast iron deposited into the cavity will cool to and through the critical transformation range at a slow enough rate to promote a substantially graphitic structure rather than as chilled iron or non-graphitic structure.

It is the object of this invention to provide an economic method for rebuilding ingot moulds and stools by depositing substantially graphitic cast iron in the cavity through an electric arc.

A method of rebuilding a grey cast iron ingot mould having a cavity eroded therein by filling the cavity with substantially graphitic cast iron comprises the steps of: filling the cavity with cast iron from a tubular wire supply by electric arc deposit; and simulateously supplying heat to the mould and cast iron deposit from the arc of the arc-deposit of cast iron to heat the cast iron pool created by the arc deposit to an extent that provides a cooling time long enough to permit substantial amounts of the carbon therein to precipitate out as graphite whereby on cooling the cavity is filled with substantially graphitic cast iron.

A machine for electric arc deposit of cast iron from a tubular wire supply into a cavity in a cast iron body comprises: a head having a plurality of outputs in spaced relation; means for suspending the head for manual manipulation to a desired position; a feed for simultaneously and continuously supplying a plurality of tubular wires to said head, one wire for each head output; means for supplying arc-maintaining voltage and current to said head. The invention will be clearly understood after reference to the following detailed specification read in conjuntion with the drawings.

In the drawings:

FIG. 1 is a schematic illustration of an ingot mould on a mould stool;

FIG. 3 is an illustration along the line 3—3 of FIG. 2.

Figure 2:
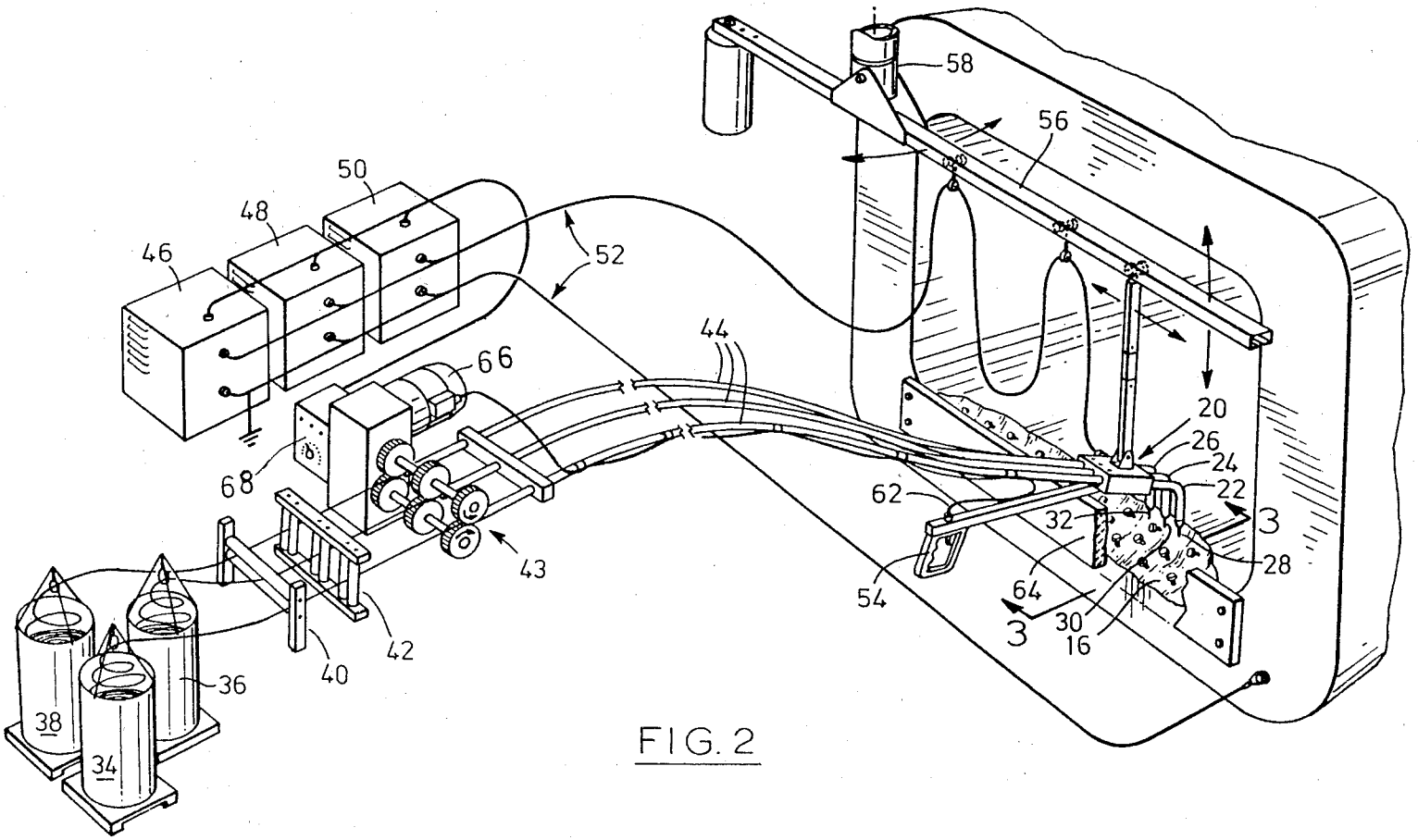
FIG. 2 is an illustration of a machine for filling the cavity of an ingot mould with cast iron and the lower edge portion of an ingot mould having a cavity eroded therein.

Referring to the drawings, FIG. 1 illustrates, schematically, an ingot mould assembly which includes a base or stool 10, and a mould 12. In steelmaking, molten steel is poured into the hole 14, in the top of the mould to fill the mould, and permitted to solidify. After solidification, the mould is lifted from the base and the steel ingot is removed. The mould is then reused to form further ingots. This process is well known.

As the steel is poured into the mould 12, it splashes on the base and against the sides of the mould and erodes a cavity in the stool and mould base and sides adjacent the inside bottom edge. Such a mould cavity is illustrated in the schematic illustration of FIG. 2, by the numeral 16. As these cavities become deeper, there is the danger of molten steel escaping through at the cavity. Moulds and stools with large cavities must either be replaced or repaired.

When cast iron of carbon equivalent of, say 4.1, is molten and allowed to cool slowly to, and through, the austenite-ferrite-pearlite transformation range, the resulting casting is soft and the carbon content is largely in the free or graphitic state. It is termed a grey cast iron. But if, instead, the molten metal is cooled very quickly, the resulting structure is exceedingly hard and brittle, with most of the carbon being chemically combined with the iron. It is termed chilled iron. Chilled iron is not desireable as a filler for the cavity in the mould. As noted above, it is brittle and difficult to grind and its coefficient of expansion, is inconsistent with the coefficient of grey cast iron of the body of the mould resulting in considerable cracking which can lead to premature weld failure. It is not entirely satisfactory. On reheating during the use of the mould, the chilled iron is subject to annealing temperatures which may cause the carbides to convert to graphite. These have a much lower density than the base metal, and create high internal stresses in the affected zone, which may develop into cracks.

This invention utilizes multiple tubular wire electrodes fed from a motor drive through wire guide cables to the output heads of an electric arc welding machine, such that all wire feed rates are controlled to provide sufficient weld metal and sufficient heat to the cavity to heat the mould and create a pool of molten cast iron that has sufficient heat therein so that it cools over a time period long enough for graphitic cast iron to form in the cavity, this deposit being fused to the cast iron of the mould.

With the invention sufficient heat can be supplied to the molten metal deposited in the cavity and surrounding area, from the arc of the output of the welder to retard the cooling rate of the weld deposit iron enough to permit carbon to precipitate as graphite whereby the cavity is filled with substantially graphitic iron that is compatible with the grey iron of the body of the mould.

The invention achieves sufficient heat producing energy through controlled current density at the arc and wire feed rate. Suitable preheat and post heat can be used as assists, depending on conditions, and wire chemistry is selected to do the job.

The precise arc energy, current density, and feed rate for a given situation will vary with circumstances. The requirement is to supply sufficient heat to heat the mould, fuse the pool of metal deposited to the metal of the mould and have enough residual heat in the deposit to form graphitic cast iron on cooling using multiple cast iron wires as a source of metal.

The achievement of these things is new.

The surface of the cavity will often be contaminated with oxidation or graphite which is difficult to weld using conventional techniques. With this invention this contamination is burned off with the extremely high current density of the arc and by correctly manipulating the arc. The oxide deposit is displaced, and the graphite is disolved or consumed in the arc and/or pool.

The following is a comparison of technical data between the method of arc depositing cast iron into the cavity by the way of a $\frac{3}{8}''$ square rod and depositing cast iron into the cavity by way of three $\frac{1}{8}''$ diameter tubular cast iron wires spaced about one inch apart and in line as illustrated in FIG. 2 of the drawings. In each case, a standard arc welding machine was used for applying the deposit.

TABLE 1

COMPARISON OF TECHNICAL DATA

| DESCRIPTION | CAST IRON ROD $\frac{3}{8}''$ Square | CAST IRON (using 3 wires) $\frac{1}{8}''$ Dia each |
|---|---|---|
| ARC DENSITY (amps/sq in) | 6400 | 57070/wire |
| ARC ENERGY - "Q" kilogoules per square millimeter per second | 8.22 | 53.42 |
| DEPOSITION RATE | | |
| (lbs/hr) | 30 | 143 |
| (cu in/min) | 1.85 | 8.83 |
| DEPOSITION EFFICIENCY | 81% | 92% |
| AMPS | 900 | 2100 |
| VOLTS | 40 | 46 |
| CARBON EQUIVALENT | 3.8 | 4.2 |

It will be noted that the density in the current of the arc in the case of the three wire deposit is nearly nine times the arc density of the case of the deposit from the single rod. This results in a dramatic increase in the amount of heat energy generated at the location of the deposit. This is reflected also in the power supplied through the arc. It will further be noted that the deposit rate the case of the three wire deposit is nearly five times the deposit rate as in the case of the single rod deposit. The increased heating effect derived from the current density increase in the arc, and from the rate of deposit increase, is sufficient to overcome the chilling effect of the mould and to result in a substantially graphitic cast iron deposit in the cavity fused to the old cavity wall. As indicated, the cavity was one of 500 cubic inches.

The resulting cooled deposit will be substantially graphitic iron but there may well be some chilled cast iron involved in the deposit or close to the original surface of the cavity in the mould. It is likely that in some applications iron just below the surface of the original cavity surface will be chilled and form a hard cast iron because the heat supplied by the arc is not great enough to fully overcome the chilling effect of the mass of the mould at this location. Moreover, it is not inconceivable that there may be some chilled iron in the deposit close to the surface of the original cavity. It is a matter of degree, the faster the cooling rate the greater the amount of chilled iron. Conditions need not be such that all chilled iron is eliminated from the deposited ore body or from the mass of the original mould. They only need be such that by and large the greater part of the deposit is graphitic iron. The substantial part of the deposit is substantially graphitic iron and has a hardness under 300 Brinnel.

It is a matter of degree and conditions will vary from situation to situation. With some large cavities there is much more heat supplied in relation to the cooling effect of the mould and the occurrence of chilled iron is less likely than with smaller cavities where there is not as much heat supplied relative to the cold sink effect of the mould.

Very small cavities, say those requiring 5 pounds of fill, are difficult because the cold sink effect of the mould is large with respect to the heat supplied and the method may not work. Average cavities are about 70 pounds of deposit. The range may well be from 20 pounds to 500 pounds but it is a practical matter in any case. Marginal applications may be assisted by preheating the mould.

FIG. 2 is a schematic illustration of a machine for filling cavities in ingot moulds according to this invention. The technical specification of the individual outputs of the machine is standard for arc welding. The machine has a head 20, with three outputs 22, 24, and 26 spaced about 1" apart in a straight line. The head and outputs are of common construction and comprise a copper head with copper tube outputs extending therefrom.

Cast iron electrode wires 28, 30, and 32 are fed from spools 34, 36, and 38, respectively through wire roller guides 40, and 42, by means of pairs of driven co-operating knurlled rollers generally indicated by the numeral 43.

After the wires pass through the supply rolls 43, they travel through flexible wire guide cables generally indicated by the numeral 44 to the copper feedhead 20. The power supplies 46, 48, and 50, to the outputs 22, 24, and 26, of the head 20 is through current cables generally indicated by the numeral 52. The head 20 is manipulated by the operator's handle 54; the head is suspended from a track 56 that can be rotated about mounting post 58. The tract pivots about the mounting post and it will be apparent that by manipulation of the handle 54, the head 20 can be moved universally within its mounting. Vertical movement is by means of adjustment in the vertical shaft or by fulcrum movement. Numeral 62 is a control cable available to the operator at the handle 54 that transmits control information back to the wire feed motor 66, and control 68.

In order to fill a weld cavity, the operator sets the controls on his welding machines according to standard procedure, sets the rate of feed 68, for the drive rollers 43 to achieve the desired feed rate of the wire to the welding head 20. The rate of feed is the same and continuous for each of the wires. Specific rates will depend on the job to be done and determined by the skill of the operator, having regard to the requirement to supply heat to the mould and deposit from the arc to heat the cast iron pool to an extent that the pool provides a cooling time long enough to permit substantial amounts of the carbon therein to precipitate out as graphite whereby on cooling the cavity is filled with substantially graphitic cast iron.

In the applications to date, the sides of the cavity were drilled and tapped to receive spaced apart steel bolts to give an additional anchor to the filling. It is thought to be optional.

A cavity in the side of the mould has been described because this is the most common cavity dealt with in steel ingot moulding practice. Cavities occur also at other places such as the centre of the stool. They are all repairable by this process.

The tubular wires can be supplied continously from suitable reels or drums or other feed mechanisms to the one illustrated so as to permit a non-interrupted welding cycle.

The cavity is, if necessary, dammed with a refractory dam 64, in order to maintain the pool as the cavity is filled. In operation, the operator applies molten cast iron by arc deposit to the bottom of the cavity and works across the mould until a body that fills the cavity is deposited.

Prior to applying the cast iron by electric arc deposit, it is often desirable to heat the mould to reduce its chilling effect. This is an assist that can be easily applied if helpful. Three wires of a diameter of ⅛" diameter and fed continuously from roll or drum in a machine similar to that schematically illustrated in FIG. 2, has been found sufficient to generate an arc energy, current density, and supply metal at a rate to form substantially graphitic iron in a cavity in the type of mould illustrated. Other rod or wire dimensions and feed arrangements will be apparent to those skilled in the art. Drums containing up to or above 600 pounds each of continuous wire, permit a continuous feed of wire as required to fill most welds.

Gas shielding in certain instances may prove beneficial but is not deemed essencial to the process. This is a matter of general welding technique known to those skilled in the welding art.

The top portion of the mould has been illustrated. The stools also develop cavities and it is intended that stools be included in the general term ingot moulds.

Embodiments of the invention other than that illustrated will be apparent to those skilled in the art.

What we claim as our invention is:

1. A method of rebuilding a grey cast iron ingot mould having a cavity eroded in the graphitic cast iron therefor by filling the whole cavity with substantially graphitic cast iron comprising the steps of:

(i) filling the whole cavity from a manually held welding head with iron from more than one continuous tubular welding wire supply by electric arc deposit; and (ii) simultaneously supply heat to the mould and cast iron deposit from the arc of the arc-deposit of cast iron at a current density and a deposition rate to burn off contamination on the cavity wall, to fuse the deposit to the mould and to heat the cast iron pool created by the arc deposit to an extent that provides a cooling time long enough to permit substantial amounts of the carbon therein to precipitate out as graphite whereby on cooling the cavity is filled with substantially graphitic cast iron.

2. A method of rebuilding a grey cast iron ingot mould as claimed in claim 1 in which said cast iron tubular wire is supplied from a roll.

* * * * *